US008881845B2

(12) United States Patent
Dewey et al.

(10) Patent No.: US 8,881,845 B2
(45) **Date of Patent: *Nov. 11, 2014**

(54) EXPANDABLE WINDOW MILLING BIT AND METHODS OF MILLING A WINDOW IN CASING

(75) Inventors: Charles H. Dewey, Houston, TX (US); Praful C. Desai, Kingswood, TX (US); John E. Campbell, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/481,470

(22) Filed: May 25, 2012

(65) Prior Publication Data

US 2012/0228032 A1 Sep. 13, 2012

Related U.S. Application Data

(63) Continuation of application No. 11/175,565, filed on Jul. 6, 2005, now Pat. No. 8,186,458.

(51) Int. Cl.

| | |
|---|---|
| ***E21B 7/04*** | (2006.01) |
| ***E21B 10/62*** | (2006.01) |
| ***E21B 7/06*** | (2006.01) |

(52) U.S. Cl.

CPC ..... *E21B 10/62* (2013.01); *E21B 7/061* (2013.01)

USPC ..... 175/61; 175/285; 175/62; 175/75

(58) Field of Classification Search

USPC ..... 166/50, 313; 175/61, 62, 76, 57, 75, 175/267, 270, 272–274, 284, 285

See application file for complete search history.

(56) References Cited

U.S. PATENT DOCUMENTS

| | | | |
|---|---|---|---|
| 2,690,897 | A | 11/1950 | Clark, Jr. |
| 2,586,878 | A | 2/1952 | Staton |

(Continued)

FOREIGN PATENT DOCUMENTS

| | | | |
|---|---|---|---|
| GB | 2242379 | A | 10/1991 |
| GB | 2323112 | A | 9/1998 |

(Continued)

OTHER PUBLICATIONS

The Patent Office—Patents Directorate, Combined Search and Examination Report under Sections 17 and 18(3) for application GB0613255.9, Newport, South Wales, Nov. 1, 2006.

(Continued)

*Primary Examiner* — David Andrews
(74) *Attorney, Agent, or Firm* — Osha Liang LLP

(57) ABSTRACT

A method of milling a window through a casing in a primary well bore and drilling a sidetracked well bore into a formation including running a drilling assembly including a body having an axis defined therethrough, a piston that is movable within a cavity formed in the body, a stationary cutting structure coupled to the body, and a movable cutting structure coupled to the body, milling a window through the casing in a first trip into the primary well bore, drilling the sidetracked well bore in the first trip into the primary well bore, applying a differential pressure across the piston, and moving the movable cutting structure from the collapsed position to the expanded position. The movable cutting structure is coupled to the piston and is movable between a collapsed position and an expanded position.

17 Claims, 5 Drawing Sheets

(56) References Cited

U.S. PATENT DOCUMENTS

| | | | | |
|---|---|---|---|---|
| 3,050,122 | A * | 8/1962 | Huitt et al. | 166/55.8 |
| 4,266,621 | A | 5/1981 | Brock | |
| 5,141,063 | A | 8/1992 | Quesenbury | |
| 5,201,817 | A * | 4/1993 | Hailey | 175/269 |
| 5,318,137 | A | 6/1994 | Johnson et al. | |
| 5,318,138 | A | 6/1994 | Dewey et al. | |
| 5,332,048 | A | 7/1994 | Underwood et al. | |
| 5,560,440 | A * | 10/1996 | Tibbitts | 175/384 |
| 5,771,972 | A | 6/1998 | Dewey et al. | |
| 5,979,571 | A | 11/1999 | Scott et al. | |
| 6,039,131 | A | 3/2000 | Beaton | |
| 6,131,675 | A * | 10/2000 | Anderson | 175/268 |
| 6,269,893 | B1 | 8/2001 | Beaton et al. | |
| 6,289,999 | B1 | 9/2001 | Dewey et al. | |
| 6,378,632 | B1 | 4/2002 | Dewey et al. | |
| 6,425,448 | B1 | 7/2002 | Zupanick et al. | |
| 6,612,383 | B2 | 9/2003 | Desai et al. | |
| 6,648,068 | B2 | 11/2003 | Robin et al. | |
| 6,695,056 | B2 | 2/2004 | Haugen et al. | |
| 6,695,074 | B2 | 2/2004 | Nackerud | |
| 6,708,769 | B2 | 3/2004 | Haugen et al. | |
| 6,732,817 | B2 | 5/2004 | Dewey et al. | |
| 6,953,096 | B2 | 10/2005 | Gledhill et al. | |
| 7,306,056 | B2 | 12/2007 | Ballantyne et al. | |
| 7,487,846 | B2 | 2/2009 | Head et al. | |
| 7,493,971 | B2 | 2/2009 | Nevlud et al. | |
| 7,503,403 | B2 | 3/2009 | Jogi et al. | |
| 7,753,139 | B2 * | 7/2010 | Dewey et al. | 175/61 |
| 8,122,977 | B2 * | 2/2012 | Dewey et al. | 175/61 |
| 8,186,458 | B2 * | 5/2012 | Dewey et al. | 175/61 |
| 2001/0035302 | A1 | 11/2001 | Desai et al. | |
| 2003/0146023 | A1 | 8/2003 | Pia | |
| 2004/0124011 | A1 | 7/2004 | Gledhill et al. | |
| 2004/0222022 | A1 | 11/2004 | Nevlud et al. | |
| 2005/0150689 | A1 | 7/2005 | Jogi et al. | |
| 2005/0252688 | A1 | 11/2005 | Head et al. | |

FOREIGN PATENT DOCUMENTS

| | | | |
|---|---|---|---|
| GB | 2341878 | A1 | 3/2000 |
| GB | 2396871 | A | 7/2004 |

OTHER PUBLICATIONS

The Patent Office—Patents Directorate, Combined Search and Examination Report under Sections 17 and 18(3) for application GB0613251.8, Newport, South Wales, Nov. 3, 2006.

USPTO Office Action in U.S. Appl. No. 11/175,567, mailed Jul. 17, 2007.

USPTO Office Action in U.S. Appl. No. 11/175,565, mailed Aug. 23, 2007.

Amendment and Response to Office Action in U.S. Appl. No. 11/175,567, filed Nov. 20, 2007.

Amendment and Response to Office Action in U.S. Appl. No. 11/175,565, filed Nov. 21, 2007.

USPTO Office Action in U.S. Appl. No. 11/175,567, mailed Feb. 12, 2008.

USPTO Office Action in U.S. Appl. No. 11/175,565, mailed Feb. 25, 2008.

Amendment and Response to Office Action in U.S. Appl. No. 11/175,565, filed May 27, 2008.

Amendment and Response to Office Action in U.S. Appl. No. 11/175,567, filed Jun. 12, 2008.

USPTO Office Action in U.S. Appl. No. 11/175,565, mailed Aug. 22, 2008.

USPTO Office Action in U.S. Appl. No. 11/175,567, mailed Oct. 15, 2008.

Amendment and Response to Office Action in U.S. Appl. No. 11/175,565, filed Nov. 24, 2008.

USPTO Office Action in U.S. Appl. No. 11/175,565, mailed Feb. 25, 2009.

Response to Office Communication and Resubmission of Amendment and Response to Office Action in U.S. Appl. No. 11/175,567, filed Apr. 17, 2009.

Amendment and Response to Office Action in U.S. Appl. No. 11/175,565, filed May 26, 2009.

USPTO Office Action in U.S. Appl. No. 11/175,567, mailed Jul. 24, 2009.

USPTO Office Action in U.S. Appl. No. 11/175,565, mailed Aug. 10, 2009.

Response to Office Action in U.S. Appl. No. 11/175,567, filed Oct. 26, 2009.

Amendment filed with Request for Continued Examination (RCE) and Response to Office Action in U.S. Appl. No. 11/175,565, filed Nov. 10, 2009.

USPTO Office Action in U.S. Appl. No. 11/175,567, mailed Jan. 13, 2010.

USPTO Office Action in U.S. Appl. No. 11/175,565, mailed Jan. 15, 2010.

Response to Final Office Action in U.S. Appl. No. 11/175,567, filed Mar. 15, 2010 with Terminal Disclaimer.

USPTO Advisory Action in U.S. Appl. No. 11/175,567, mailed Mar. 23, 2010.

Amendment and Resp. to Office Action in U.S. Appl. No. 11/175,565, filed Apr. 15, 2010.

Supplemental Response to Final Office Action in U.S. Appl. No. 11/175,567, filed Apr. 15, 2010.

USPTO Notice of Allowance and Fees Due in U.S. Appl. No. 11/175,567, mailed May 13, 2010.

USPTO Office Action in U.S. Appl. No. 11/175,565, mailed Jul. 1, 2010.

Submission Accompanying Request for Continued Examination in U.S. Appl. No. 11/175,565, filed Oct. 29, 2010.

USPTO Office Action in U.S. Appl. No. 11/175,565, mailed Dec. 16, 2010.

USPTO Office Action in U.S. Appl. No. 12/779,759, mailed Jan. 7, 2011.

Reply under 37 C.F.R. § 1.111 in U.S. Appl. No. 11/175,565, filed Mar. 16, 2011.

Reply and Amendment in U.S. Appl. No. 12/779,759, filed Apr. 7, 2011.

USPTO Office Action in U.S. Appl. No. 11/175,565, mailed May 18, 2011.

USPTO Office Action in U.S. Appl. No. 12/779,759, mailed May 20, 2011.

Reply in U.S. Appl. No. 12/779,759, filed Jul. 20, 2011 with Terminal Disclaimer.

USPTO Advisory Action in U.S. Appl. No. 12/779,759, mailed Aug. 10, 2011.

Submission Accompanying Request for Continued Examination in U.S. Appl. No. 11/175,565, filed Sep. 19, 2011.

Amendment in U.S. Appl. No. 12/779,759, filed Sep. 20, 2011.

USPTO Notice of Allowance and Fees Due in U.S. Appl. No. 12/779,759, mailed Oct. 19, 2011.

USPTO Notice of Allowance and Fees Due in U.S. Appl. No. 11/175,565, mailed Jan. 31, 2012.

* cited by examiner

EXPANDABLE WINDOW MILLING BIT AND METHODS OF MILLING A WINDOW IN CASING

CROSS-REFERENCE TO RELATED APPLICATIONS

The present application is a continuation application, and thus claims benefit pursuant to 35 U.S.C. §120 of U.S. patent application Ser. No. 11/175,565, filed Jul. 6, 2005, now U.S. Pat. No. 8,186,458, issued May 29, 2012, which is related to U.S. patent application Ser. No. 11/175,567, filed Jul. 6, 2005, now U.S. Pat. No. 7,753,139, issued Jul. 13, 2010, both of which are incorporated by reference in their entireties.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates generally to methods and apparatus for drilling an enlarged sidetracked well bore from an existing primary well bore in geologic formations, and more particularly, to methods and apparatus for milling a window through casing lining a primary well bore, and drilling an enlarged sidetracked well bore through the casing window, all in one trip into the primary well bore.

BACKGROUND

Once a petroleum well has been drilled and cased, it may be desirable to drill one or more additional sidetracked well bores that branch off, or deviate, from the primary well bore. Such multilateral well bores are typically directed toward different targets within the surrounding formation, with the intent of increasing the production output of the well.

Multilateral technology provides operators several benefits and economic advantages, such as tapping isolated pockets of hydrocarbons that might otherwise be left unproduced, and improving reservoir drainage so as to increase the volume of recoverable reserves and enhance the economics of marginal pay zones. By utilizing multilateral technology, multiple reservoirs can also be drained simultaneously, and thin production intervals that might be uneconomical to produce alone may become economical when produced together. Multiple completions from one well bore also facilitate heavy oil drainage.

In addition to production cost savings, development costs also decrease through the use of existing infrastructure, such as surface equipment and the primary well bore. Multilateral technology expands platform capabilities where slots are limited and eliminates spacing problems by allowing more drain holes to be added within a reservoir. In addition, by sidetracking damaged formations or completions, the life of existing wells can be extended. For example, sidetracked well bores may be drilled below a problem area once the casing has been set, thereby reducing the risk of drilling through troubled zones. Finally, multilateral completions accommodate more wells with fewer footprints, making them ideal for environmentally sensitive or challenging areas.

To maximize the productivity of multilateral completions, it is desirable to enlarge at least some of the sidetracked well bores to thereby increase the production flow area through such boreholes. By drilling a sidetracked well bore through a casing window, and then enlarging the sidetracked well bore beyond the casing window, the far reaches of the reservoir can be reached with a comparatively larger diameter borehole, thereby providing more flow area for the production of oil and gas.

However, conventional methods for drilling an enlarged sidetracked well bore require multiple trips into the primary well bore. For example, a first trip may be made into the primary well bore to run and set an anchored whipstock comprising an inclined face that guides a window mill radially outwardly into the casing to cut a window in the casing. The window mill is then tripped out of the primary well bore, and a drill bit is lowered in a second trip to drill the sidetracked well bore through the casing window. The diameter of the sidetracked well bore is thereby limited by the diameter or gauge of the drill bit that can extend through the casing window. Once the sidetracked well bore has been drilled, the drill bit is then tripped out of the primary well bore, and another drilling assembly, such as a drill bit followed by a reamer, for example, is lowered in a third trip into the primary well bore to extend and enlarge the sidetracked well bore. It is both expensive and time consuming for an operator to make multiple trips into a primary well bore to drill and enlarge a single sidetracked well bore, and such concerns are only compounded when drilling more than one sidetracked well bore in a multilateral completion.

Thus, in recent years, a window milling bit comprising diamond cutters has been developed that is operable to mill a window through a standard metal casing and drill a sidetracked well bore through the casing window in a single trip into the primary well bore. This window milling bit with diamond cutters thereby eliminates one trip into the primary well bore, but at least another trip is still required to enlarge the sidetracked well bore. Therefore, a need exists for apparatus and methods that enable milling a window through a casing in a primary well bore, and drilling an enlarged sidetracked well bore through the casing window in one trip into the well bore.

To perform such a sidetracking operation, it would also be advantageous to provide a single cutting device capable of both milling the casing and drilling an enlarged sidetracked well bore. Such a device is desirable to provide a more compact drilling assembly for increased maneuverability and control while drilling the enlarged sidetracked well bore through the casing window.

Further, when operating a window milling bit to mill casing and drill formation, whether drilling an enlarged borehole or not, the cutting structures on such a bit may be worn down during operation. Thus, a need exists for a cutting device with multiple cutting structures adapted to recover gauge as the device is used to mill through casing and/or drill into formation. In addition, it may be desirable for the window milling bit to have at least a first cutting structure to perform the milling operation, and at least a second cutting structure to perform the drilling operation. Thus, a need exists for a cutting device with multiple cutting structures wherein at least one of the cutting structures is selectively presented when desired by the operator. Such a cutting device would be useful for many other purposes, including drilling through different types of formation rock, or replacing worn cutting structures when drilling a lengthy borehole, for example.

The present invention addresses the deficiencies of the prior art.

SUMMARY

In one aspect, the present disclosure relates to a method of milling a window through a casing in a primary well bore and drilling an enlarged sidetracked well bore. In an embodiment, the method comprises running into the primary well bore a drilling assembly comprising at least one cutting apparatus adapted to drill an enlarged borehole, milling a window through the casing, and drilling the enlarged sidetracked well bore, wherein the milling and drilling steps are performed in one trip into the primary well bore. The method may further comprise steering the drilling assembly and/or stabilizing the drilling assembly.

In another aspect, the present disclosure relates to a drilling assembly comprising at least one cutting apparatus operable to drill an enlarged borehole, wherein the drilling assembly is operable to mill a window through a casing in a primary well bore and drill an enlarged sidetracked well bore through the window in one trip into the primary well bore. In various embodiments, the drilling assembly may further comprise a bent housing motor, a rotary steerable system, and/or a stabilizer. In one embodiment, the at least one cutting apparatus comprises an expandable window milling bit having at least a collapsed position and an expanded position, and the expandable bit may comprise on/off control and/or diamond cutters operable to mill the window in the collapsed position and drill the enlarged sidetracked well bore in the expanded position. In another embodiment, the at least one cutting apparatus comprises a window milling bit and a reamer. The window milling bit may comprise a stationary cutting structure and a movable cutting structure. Further, an original operable gauge of the moveable cutting structure may substantially equal an original gauge of the stationary cutting structure. In yet another embodiment, one or both of the window milling bit and the reamer are expandable, and at least one expandable component may comprise on/off control. In still another embodiment, the at least one cutting apparatus comprises a bi-center bit.

In another aspect, the present disclosure relates to a method of milling a window through a casing in a primary well bore and drilling an enlarged sidetracked well bore into a formation comprising running into the primary well bore a system comprising a reamer and a mill with diamond cutters, milling a window through the casing with the diamond cutters, and drilling the enlarged sidetracked well bore, wherein the milling and drilling steps are performed in one trip into the primary well bore. The method may further comprise steering the system and/or stabilizing the system. In an embodiment, the drilling step comprises operating at least one of the mill and the reamer in an expanded position. The method may further comprise controlling whether an expandable component is on or off. In an embodiment, drilling the enlarged sidetracked well bore comprises creating an initial sidetracked well bore with the mill and enlarging the initial sidetracked well bore with the reamer. The method may further comprise using a first cutting structure of the mill during the milling step and using a second cutting structure of the mill during the drilling step. In an embodiment, the first cutting structure protects the second cutting structure during the milling step.

Other aspects and advantages of the invention will be apparent from the following description and the appended claims. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the present invention, reference will now be made to the accompanying drawings, wherein.

NOTATION AND NOMENCLATURE

Figure 1:
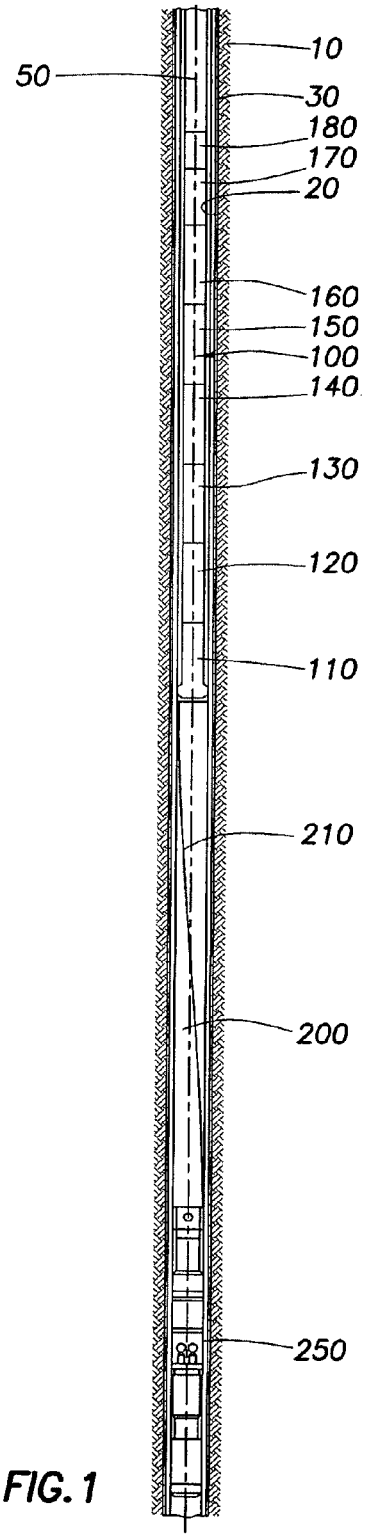
FIG. 1 is a cross-sectional side view depicting one embodiment of method for milling a casing window and drilling an enlarged sidetracked well bore, with a representative drilling assembly shown connected to a whipstock and an anchor being run into a primary cased well bore.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", or "upstream" meaning toward the earth's surface or toward the entrance of a well bore; and "down", "lower", or "downstream" meaning toward the bottom or terminal end of a well bore.

DETAILED DESCRIPTION

Various embodiments of methods and apparatus for milling a casing window and drilling an enlarged sidetracked well bore in one trip into a primary well bore, and various embodiments of a cutting device comprising multiple cutting structures, will now be described with reference to the accompanying drawings, wherein like reference numerals are used for like features throughout the several views. There are shown in the drawings, and herein will be described in detail, specific embodiments of drilling assemblies and cutting devices with the understanding that this disclosure is representative only, and is not intended to limit the invention to those embodiments illustrated and described herein. The embodiments of the apparatus disclosed herein may be utilized in any type of milling, drilling or sidetracking operations. It is to be fully recognized that the different teachings of the embodiments disclosed herein may be employed separately or in any suitable combination to produce desired results.

Figure 2:
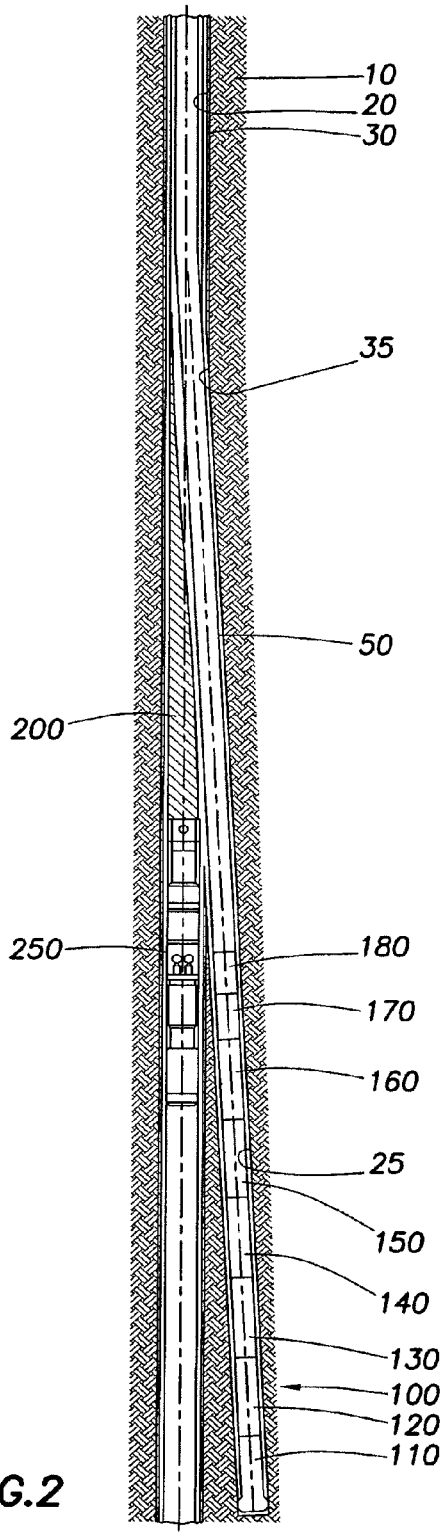
FIG. 2 is a cross-sectional side view of the method of FIG. 1 showing the drilling assembly drilling an enlarged sidetracked well bore through a casing window that was milled by a lead cutting device of the drilling assembly.

FIG. 1 and FIG. 2 depict two sequential, cross-sectional side views of a method for milling a window 35 through a casing 30 lining a primary well bore 20, and drilling an enlarged sidetracked well bore 25 into the surrounding formation 10. As used herein, an enlarged sidetracked well bore 25 is a sidetracked well bore with a diameter greater than the diameter of a window milling bit 110 or other tool used to mill the casing window 35.

Referring first to FIG. 1, the method comprises lowering a bottomhole drilling assembly 100 connected to a whipstock 200 and an anchor 300 into the primary well bore 20 via a drill string 50 using conventional techniques. In one embodiment, the drilling assembly 100 comprises a window milling bit 110 at its lower end that is capable of milling through the casing 30 and drilling into the formation 10. One example of such a window milling bit 110 is depicted and described in U.S. Pat. No. 6,648,068, hereby incorporated herein by reference for all purposes.

The drilling assembly 100 may further comprise various other components 120, 130, 140, 150, 160, 170 and 180. For example, in addition to the window milling bit 110, the drilling assembly 100 may comprise a directional device 120, a measurement-while-drilling (MWD) tool 130, a logging-while-drilling (LWD) tool 140, one or more additional mills 150, a borehole enlarging device 160, one or more drill collars 170, and a stabilizer 180, for example. Although components 120, 130, 140, 150 and 170 may be provided in the drilling assembly 100, such apparatus are entirely optional and would not be required to perform any of the methods disclosed herein. Further, in some embodiments of the methods of the present invention, the bore hole enlarging device 160 and/or the stabilizer 180 may not be required.

When the drilling assembly 100, whipstock 200 and anchor 300 have been lowered to a desired depth in the primary well bore 20 by the drill string 50, the whipstock 200 is angularly oriented so that an inclined surface 210 of the whipstock 200 faces in the desired direction for drilling the enlarged sidetracked well bore 25. Once the whipstock 200 is oriented, it is then set into place via the anchor 300 disposed at the lower end thereof, as shown in FIG. 1. The anchor 300 engages the surrounding casing 30 to lock the whipstock 200 into place against both axial and rotational movement during operation.

When the whipstock 200 has been angularly oriented and set into place by the anchor 300 in the primary well bore 20, the drilling assembly 100 disconnects from the whipstock 200 and proceeds to mill the window 35 through the casing 30. Specifically, the window milling bit 110 is rotated and lowered while engaging the inclined surface 210 of the whipstock 200, which acts to guide the window milling bit 110 radially outwardly into cutting engagement with the casing 30 to mill a window 35 therethrough.

As depicted in FIG. 2, the method further comprises extending the drilling assembly 100 through the casing window 35 and drilling into the formation 10 to form an enlarged sidetracked well bore 25. The various embodiments of the method for forming the enlarged sidetracked well bore 25 depend, in part, upon which components comprise the drilling assembly 100. For example, in one embodiment, the drill string 50 comprises standard jointed pipe and conventional drilling is performed wherein the entire drill string 50 and drilling assembly 100 are rotated from the surface of the primary well bore 20. In another embodiment, the drill string 50 may comprise either jointed pipe or coiled tubing, and the drilling assembly 100 comprises a directional device 120, such as a bent housing motor or a rotary steerable system, for example, operably connected to the window milling bit 110 to rotate and/or steer the bit 110 during operation. When using a bent housing motor system as the directional device 120, drilling into the formation 10 is achieved by sliding the drill string 50, whereas a rotary steerable system would allow the drill string 50 to continue to rotate while steering the window milling bit 110. Therefore, it may be advantageous to use jointed drill pipe 50 and a rotary steerable system as the directional device 120 when drilling a long borehole into the formation 10.

In one embodiment of the method for forming an enlarged sidetracked well bore 25, the drilling assembly 100 comprises at least the window milling bit 110, which is adapted to drill an initial sidetracked well bore, and a well bore enlarging device 160, such as a reamer, for example, that follows behind the window milling bit 110 to expand the initial borehole and thereby form the enlarged sidetracked well bore 25. The window milling bit 110 can drill the initial sidetracked well bore at the same time as the reamer 160 enlarges the borehole to form the enlarged sidetracked well bore 25.

In one embodiment, the reamer 160 is expandable and has basically two operative states—a closed or collapsed state, where the diameter of the reamer 160 is sufficiently small to allow it to pass through the casing window 35, and an open or partly expanded state, where one or more arms with cutters on the ends thereof extend from the body of the reamer 160. In this latter position, the reamer 160 expands the diameter of the initial sidetracked well bore to form the enlarged sidetracked well bore 25 as the reamer 160 is rotated and advanced in the borehole.

As one of ordinary skill in the art will readily recognize, there are a wide variety of expandable reamers 160 capable of forming an enlarged sidetracked well bore 25. For purposes of example, and not by way of limitation, one type of expandable reamer 160 is depicted and described in U.S. Pat. No. 6,732,817, hereby incorporated herein by reference for all purposes. Such a reamer 160 comprises moveable arms with borehole engaging pads comprising cutting structures. The arms translate axially upwardly along a plurality of angled channels disposed in the body of the reamer 160, while simultaneously extending radially outwardly from the body. The reamer 160 alternates between collapsed and expanded positions in response to differential fluid pressure between a flowbore in the reamer 160 and the wellbore annulus. Specifically, fluid flowing through the flowbore enters a piston chamber through ports in a mandrel to actuate a spring-biased piston, which drives the moveable arms axially upwardly and radially outwardly into the expanded position. When the fluid flow ceases, the differential pressure is eliminated, and the reamer 160 returns to the collapsed position.

In a first embodiment, the ports into the piston chamber remain open, so the reamer 160 expands and contracts automatically in response to changes in differential pressure. In a second embodiment, the reamer 160 includes on/off control. For example, the reamer 160 may comprise an internal stinger biased to block the ports into the piston chamber to prevent the piston from actuating in response to differential pressure between the flowbore and the wellbore annulus. This internal stinger may be aligned using an actuator, such as the flow switch depicted and described in U.S. Pat. No. 6,289,999, to open the ports into the piston chamber. Once these ports are open, differential pressure between the flowbore and the wellbore annulus will actuate the piston. Thus, this second embodiment of the reamer 160 is selectively actuatable, thereby providing the operator with on/off control.

Another representative type of expandable reamer 160 is depicted and described in U.S. Patent Publication No. US 2004/0222022-A1, hereby incorporated herein by reference for all purposes. This type of reamer 160 comprises moveable arms that are radially translatable between a retracted position and a wellbore engaging position, and a piston mechanically supports the moveable arms in the wellbore engaging position when an opposing force is exerted. The piston is actuated by differential pressure between a flowbore within the reamer 160 and the wellbore annulus. This type of reamer 160 may also include on/off control. For example, in one embodiment, the reamer 160 may comprise a sliding sleeve biased to isolate the piston from the flowbore, thereby preventing the moveable arms from translating between the retracted position and the wellbore engaging position. A droppable or pumpable actuator may be used to align the sliding sleeve to expose the piston to the flowbore and actuate the piston. Thus, this embodiment of the reamer 160 is selectively actuatable to provide the operator with on/off control.

Another representative type of expandable reamer 160 utilizes swing out cutter arms that are hinged and pivoted at an end opposite the cutting end of the arms, which have roller cones attached thereto. The cutter arms are actuated by mechanical or hydraulic forces acting on the arms to extend or retract them. Typical examples of this type of reamer 160 are found in U.S. Pat. Nos. 3,224,507; 3,425,500 and 4,055,226, hereby incorporated herein by reference for all purposes. As one of ordinary skill in the art will readily understand, while specific embodiments of expandable reamers 160 have been explained for purposes of illustration, there are many other types of expandable reamers 160 that would be suitable for use in forming an enlarged sidetracked well bore 25. Therefore, the methods and apparatus of the present invention are not limited to the particular embodiments of the expandable reamers 160 discussed herein.

In another embodiment of the method for forming an enlarged sidetracked well bore 25, the well bore enlarging device 160 that follows the window milling bit 110 is a winged reamer. A winged reamer 160 generally comprises a tubular body with one or more longitudinally extending "wings" or blades projecting radially outwardly from the tubular body. Once the winged reamer 160 has passed through the casing window 35, the window milling bit 110 rotates about the centerline of the drilling axis to drill an initial sidetracked borehole on center in the desired trajectory of the well path, while the eccentric winged reamer 160 follows the bit 110 and engages the formation 10 to enlarge the initial borehole to the desired diameter of the enlarged sidetracked well bore 25. Winged reamers 160 are well known to those of ordinary skill in the art.

Yet another method for milling the casing window 35 and drilling the enlarged sidetracked well bore 25 comprises replacing the standard window milling bit 110 with a bi-center bit, which is a one-piece drilling structure that provides a combination reamer and pilot bit. The pilot bit is disposed on the lowermost end of the drilling assembly 100, and the eccentric reamer bit is disposed slightly above the pilot bit. Once the bi-center bit passes through the casing window 35, the pilot bit portion rotates about the centerline of the drilling axis and drills an initial sidetracked borehole on center in the desired trajectory of the well path, while the eccentric reamer bit portion follows the pilot bit and engages the formation 10 to enlarge the initial borehole to the desired diameter of the enlarged sidetracked well bore 25. The diameter of the pilot bit is made as large as possible for stability while still being capable of passing through the cased primary well bore 20. Examples of bi-center bits may be found in U.S. Pat. Nos. 6,039,131 and 6,269,893.

Figure 4:
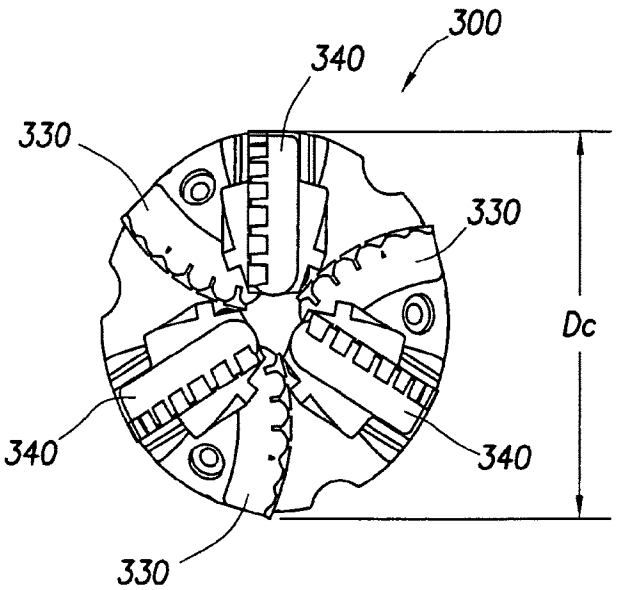
FIG. 4 depicts an end view of the cutting device of FIG. 3 in the collapsed position.
Figure 3:
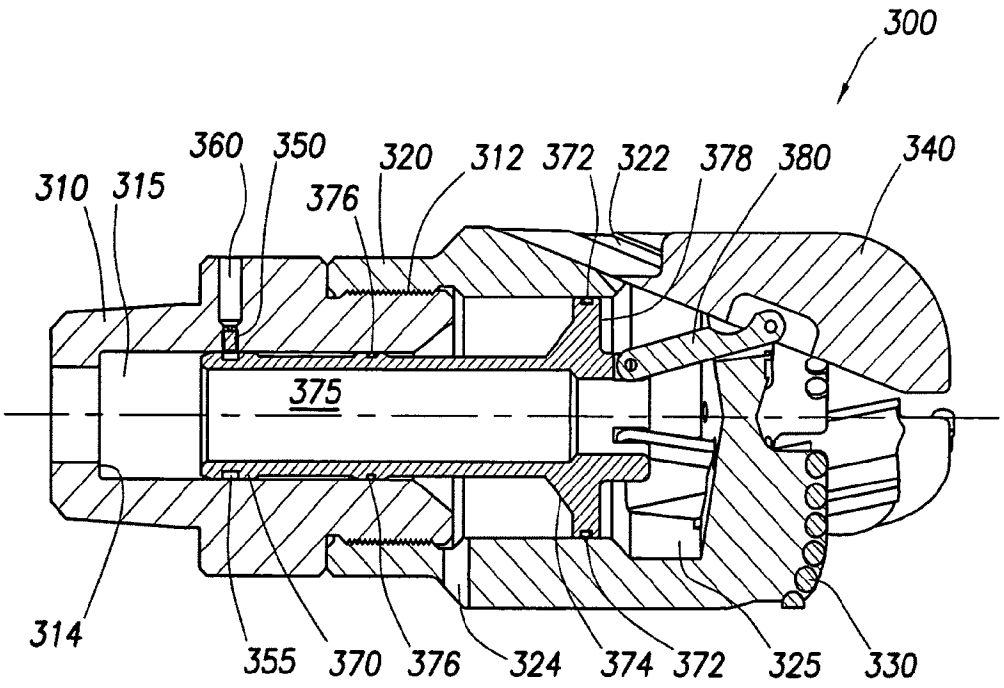
FIG. 3 is a cross-sectional side view of one embodiment of a cutting device with multiple cutting structures, wherein the device is shown in a collapsed position.
Figure 6:
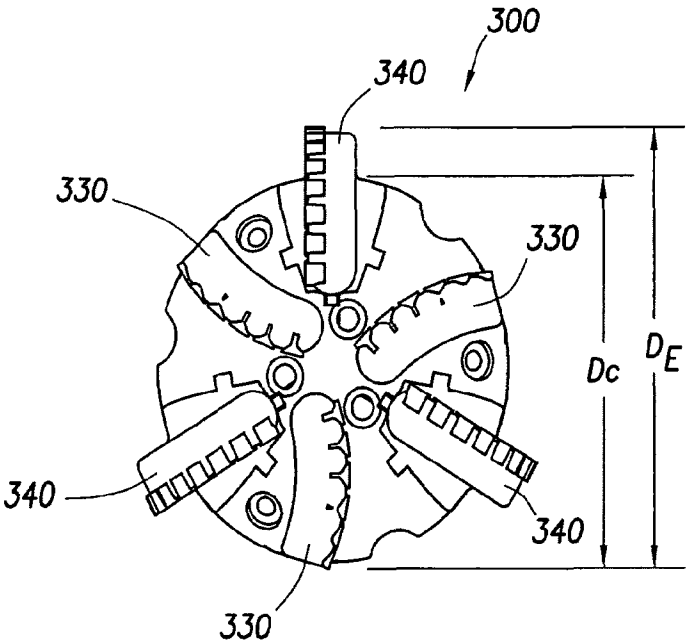
FIG. 6 depicts an end view of the cutting device of FIG. 3 in the expanded position.
Figure 5:
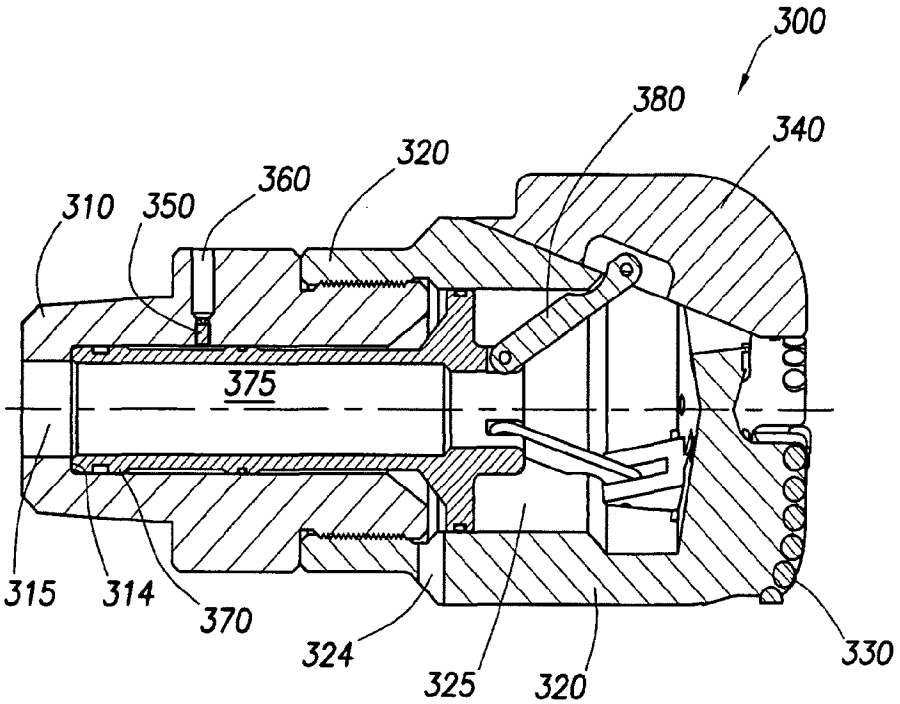
FIG. 5 is a cross-sectional side view of the cutting device of FIG. 3, wherein the device is shown in an expanded position.

Another method for milling the casing window 35 and drilling the enlarged sidetracked well bore 25 comprises replacing the standard window milling bit 110 with an expandable cutting device. One embodiment of such an expandable device is the cutting device 300 shown in FIGS. 3-6. The cutting device 300 is adapted to mill the casing window 35 and drill the enlarged sidetracked well bore 25 therethrough. In particular, FIGS. 3-4 depict a cross-sectional side view and an end view, respectively, of the cutting device 300 in a collapsed position for milling the casing window 35, and FIGS. 5-6 depict a cross-sectional side view and an end view, respectively, of the cutting device 300 in an enlarged position for drilling the enlarged sidetracked well bore 25. The collapsed diameter $D_C$ of the cutting device 300 shown in FIGS. 3-4 is smaller than the expanded diameter $D_E$ of the cutting device 300 shown in FIGS. 5-6. In one embodiment, the collapsed diameter $D_C$ may be 12¼ inches, and the expanded diameter $D_E$ may be 14¾ inches to 15 inches, for example.

The cutting device 300 comprises an upper section 310 with an internal flow bore 315, a body 320 with angled tracks 322 and an internal chamber 325, one or more stationary cutting structures 330 disposed on the lower end of the body 320, one or more moveable cutter blocks 340, a moveable piston 370 with an internal flowbore 375, and one or more links 380 that connect the moveable cutter blocks 340 to the piston 370. Thus, at least one and any number of multiple moveable cutter blocks 340 may be connected to the piston 370. In the embodiments shown in FIGS. 3-6, three stationary cutting structures 330 are disposed 120 degrees apart circumferentially, and three moveable cutter blocks 340 are disposed 120 degrees apart circumferentially. Thus, the stationery cutting structures 330 alternate with the moveable cutter blocks 340 such that cutters are positioned 60 degrees apart circumferentially, as best depicted in FIGS. 4 and 6. The stationary cutting structures 330 and the moveable cutter blocks 340 may comprise the same or different types of cutters, such as diamond cutters and/or tungsten carbide cutters, for example.

A threaded connection 312 is provided between the upper section 310 and the lower section. The piston 370 extends into both the upper section flowbore 315 and the internal chamber 325, and seals 372, 376 are provided between the piston 370 and the body 320, and between the piston 370 and the upper section 310, respectively. An upper end 374 of the piston 370 is in fluid communication with the primary well bore 20 via a port 324 in the body 320, and a lower end 378 of the piston 370 is in fluid communication with the internal chamber 325 of the body 320.

In operation, the cutting device 300 is run into the primary well bore 20 in the collapsed position shown in FIGS. 3-4. In this configuration, the piston 370 is pushed axially forward toward the downstream direction, which thereby causes the moveable cutter blocks 340 to be pushed axially forward in the downstream direction via link 380. Disposed in a counterbore 360 in the upper section 310 is a shear screw 350 that engages a shear groove 355 in the piston 370 to maintain the piston 370 in the position shown in FIGS. 3-4. In other embodiments, the piston 370 may be spring-loaded to bias to the collapsed position.

As shown in FIGS. 3-4, the cutting device 300 has a first collapsed diameter $D_C$, and the moveable cutter blocks 340 are positioned axially forward, or downstream, of the stationary cutting structures 330. Because the moveable cutter blocks 340 are positioned ahead of the stationary cutting structures 330, they will perform most of the cutting required to mill the window 35 through the casing 30. However, the stationary cutting structures 330 may also assist in milling the casing window 35.

When the casing window 35 is complete, the cutting device 300 continues to drill ahead into the formation 10 at least until the upper section 310 is clear of the window 35. Then the cutting device 300 may be actuated to the expanded position shown in FIGS. 5-6 to drill the enlarged sidetracked well bore 25. In the embodiments shown in FIGS. 3-6, the cutting device 300 is actuated hydraulically, but one of ordinary skill in the art will recognize that such actuation can be performed by any means, including mechanically, electrically, chemically, explosively, etc. or a combination thereof.

To actuate the cutting device 300 to the expanded position, the piston 370 must be released from the position shown in FIGS. 3-4 and then retracted to the position shown in FIGS. 5-6. In particular, the drilling fluid in the internal chamber 325 acting on the lower end 378 of the piston 370 must be pressured up to exceed the pressure in the primary well bore 20 that acts on the upper end 374 of the piston 370 through port 324. This differential pressure must be sufficient to shear the shear screw 350 and retract the released piston 370 until it engages a shoulder 314 within the flowbore 315 of the upper section 310, as best depicted in FIG. 5. As the piston 370 retracts in response to this differential pressure, the moveable cutter blocks 340 will also be retracted since they are connected to the piston 370 via links 380. As the moveable cutter blocks 340 retract in the axially upward, or upstream, direction, they are simultaneously directed radially outwardly along the angled tracks 322 in the body 320, such as tongue-and-groove tracks 322. Thus, the moveable cutter blocks 340 are expanded radially outwardly to an enlarged diameter $D_E$ as shown in FIGS. 5-6. As one of ordinary skill in the art will appreciate, the size of the enlarged diameter $D_E$ is based, in part, on the length of the piston 370 and the angle of the tracks 322 in the body 320.

In other embodiments, the cutting device 300 may include on/off control. For example, the cutting device 300 may comprise a slideable sleeve capable of blocking the port 324 that provides fluid communication between the piston 370 and the primary well bore 20. In this blocked configuration, the cutting device 300 would be "off" since there would be no differential pressure acting on the piston 370 to make it retract or extend. However, selectively moving the slideable sleeve to open the port 324 would turn the cutting device 300 "on" since the piston 370 could then actuate in response to differential pressure as described above.

In the expanded position, the cutting device 300 will drill the enlarged sidetracked well bore 25. In the embodiments shown in FIGS. 3-6, the moveable cutter blocks 340 and the stationary cutting structures 330 will drill the face portion (i.e. end) of the enlarged sidetracked well bore 25, and the moveable cutter blocks 340 will drill the gauge portion (i.e. diameter) of the enlarged sidetracked well bore 25 substantially alone, without the stationary cutting structures 330. Thus, in one embodiment, the apparatus comprises a one-trip milling and drilling assembly 100 with a single expandable cutting device 300 disposed at an end thereof for milling a window 35 through casing 30 in the primary well bore 20 and drilling an enlarged sidetracked well bore 25. In another aspect, the apparatus comprises a cutting device 300 comprising multiple cutting structures 330, 340 wherein at least one of the cutting structures is selectively presented.

Figure 7:
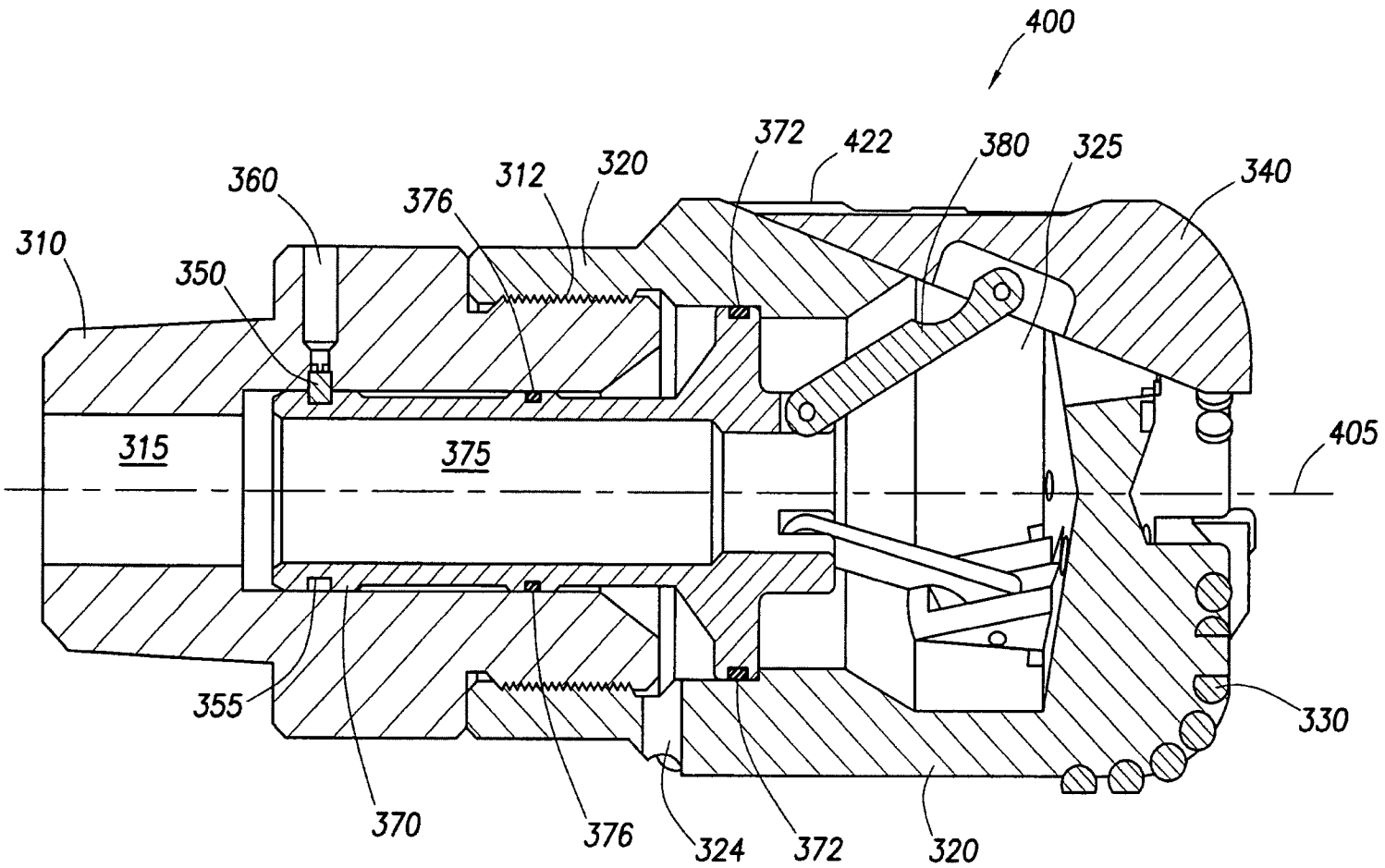
FIG. 7 is a cross-sectional view of another embodiment of a cutting device with multiple cutting structures, wherein a moveable cutter block is shown in a first position.
Figure 8:
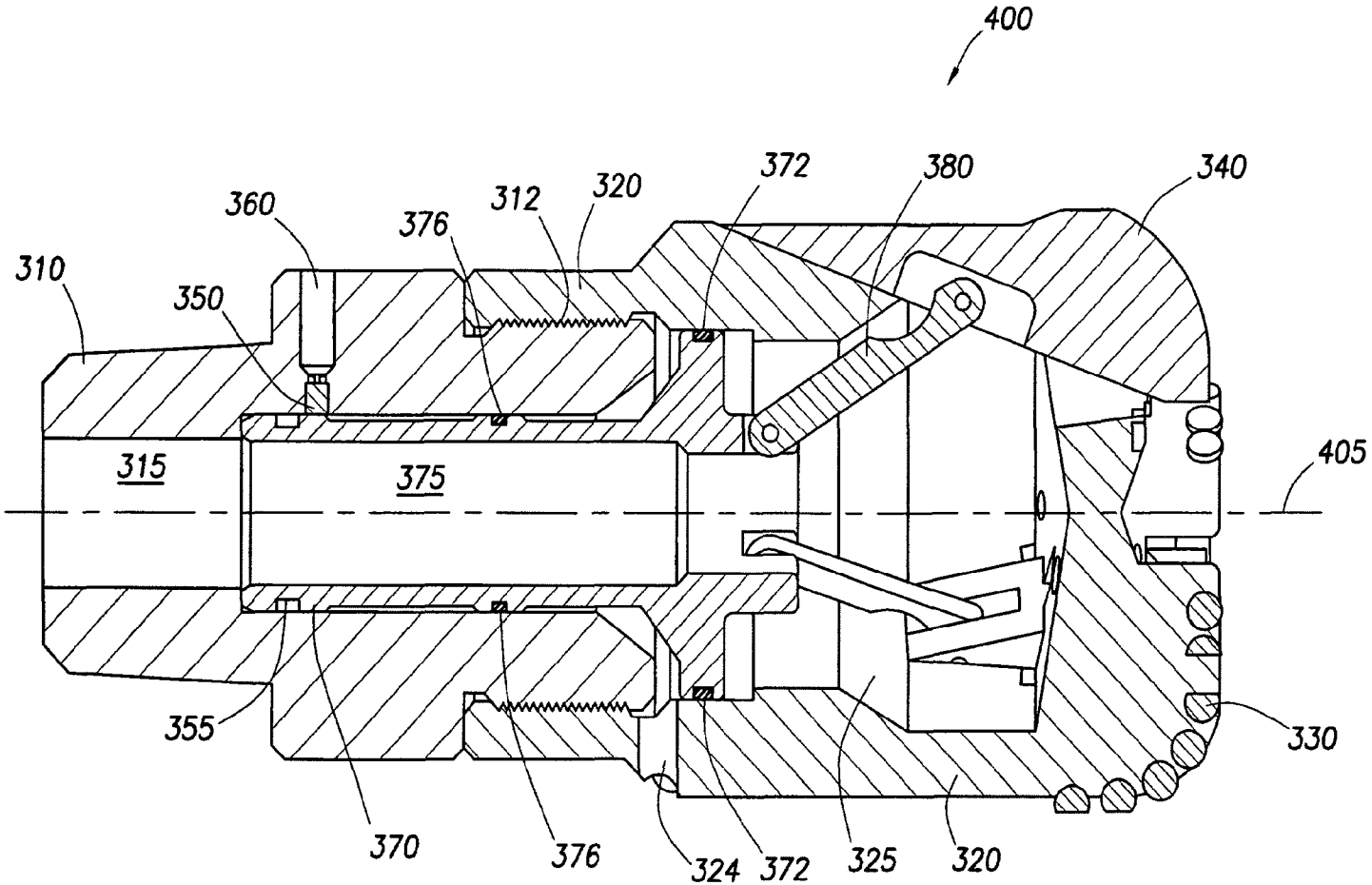
FIG. 8 is a cross-sectional side view of the cutting device of FIG. 7, wherein the moveable cutter block is shown in a second position.

Referring again to FIGS. 1-2, in drilling operations, and especially when drilling an enlarged borehole, it is advantageous to employ a stabilizer 180, which may be positioned in the drilling assembly 100 above the reamer 160, separated by one or more drill collars 170. Alternatively, if the expandable cutting device 300 is used to form the enlarged sidetracked well bore 25, the reamer 160 may or may not be provided, and the stabilizer 170 could be positioned where the reamer 160 is shown. The stabilizer 170 provides centralization and may control the trajectory and the inclination of the window milling bit 110 or the cutting device 300 as drilling progresses. The stabilizer 170 may be a fixed blade stabilizer, or an expandable concentric stabilizer, such as the expandable stabilizers described in U.S. Pat. Nos. 5,318,137; 5,318,138; and 5,332,048, for example FIGS. 7-8 depict an alternative embodiment of a cutting device 400 comprising multiple cutting structures 330, 340 having many of the same components as the cutting device 300 shown in FIGS. 3-6. However, the alternative cutting device 400 comprises tracks 422 having a much smaller angle than the tracks 322 depicted in FIGS. 3-6. In various embodiments, the tracks 422 may have only a slight angle, or the tracks 422 may be substantially parallel to a longitudinal axis 405 of the alternative cutting device 400.

FIG. 7 depicts one embodiment of the alternative cutting device 400 comprising tracks 422 having a slight angle in the collapsed position (corresponding to FIG. 3 for cutting device 300), and FIG. 8 depicts the alternative cutting device 400 in the expanded position (corresponding to FIG. 5 for cutting device 300). In this embodiment, the alternative cutting device 400 is operable to recover gauge that is worn away during milling or drilling. In more detail, when the alternative cutting device 400 is in the position shown in FIG. 7, the moveable cutting structures 340 are positioned axially forward, or downstream of, and radially inwardly of, the stationary cutting structures 330. Thus, whether milling a casing window 35 or drilling into the formation 10 in the position shown in FIG. 7, the moveable cutter blocks 340 will mill or drill the face portion of the window 35 or borehole, whereas the stationary cutting structures 330 will substantially mill or drill the gauge portion. As such, the stationary cutting structures 330 will lose gauge over time. By way of example, the initial gauge of the stationary cutting structures 330 may be 12¼ inches, but after milling or drilling, the gauge may be reduced to 12 inches. Therefore, to recover the lost ¼ inch gauge, the alternative cutting device 400 is actuated to the position shown in FIG. 8. When actuated, the moveable cutter blocks 340 are retracted axially by the piston 370 via link 380 while simultaneously traversing radially outwardly along the slightly angled tracks 422. This slight expansion of the moveable cutter blocks 340 is designed to recover the gauge lost by the stationary cutting structures 330 so that milling or drilling may continue at the same original gauge. For example, the moveable cutter blocks 340 in the position shown in FIG. 8 may have a gauge of substantially 12¼ inches.

In another embodiment, the alternative cutting device 400 may comprise tracks 422 that are substantially parallel to the axis of the cutting device 400. In this embodiment, the cutting device 400 may comprise, for example, a first cutting structure presented for milling and a second cutting structure selectively presented for drilling. For example, if the cutting device 400 of FIGS. 7-8 comprised tracks 422 that were substantially parallel to the axis of the cutting device 400, the moveable cutter blocks 340 would be positioned axially forwardly of, and at a slightly greater radial expansion as the stationary cutting structures 330 in the position of FIG. 7. Thus, the moveable cutter blocks 340 would mill the casing window 35 while protecting the stationary cutting structures 330. Also in this embodiment, when the cutting device 400 is actuated to the position shown in FIG. 8, the moveable cutter blocks 340 would be retracted directly axially upstream to thereby reveal the stationary cutting structures 330, which would perform the drilling operation in conjunction with the moveable cutter blocks 340.

As one of ordinary skill in the art will readily appreciate, such a cutting device 400 with substantially parallel tracks 422 could comprise multiple cutting structures of various types, such as PDC cutters and tungsten carbide cutters, for example, wherein each type of cutting structure is designed for a specific purpose. Such a cutting device 400 could also be used for a variety of different purposes. For example, the cutting device 400 could be used to drill any type of borehole into the formation 10, with each of the multiple cutting structures being presented as necessary due to a change in the type of rock comprising the formation 10, or due to a shift in the integrity of the formation 10, for example. It may also be advantageous to provide multiple cutting structures of the same type so that as one cutting structure becomes worn, another cutting structure can be presented. One of ordinary skill in the art will readily understand that many other variations are possible and are well within the scope of the present application.

The foregoing descriptions of specific embodiments have been presented for purposes of illustration and description and are not intended to be exhaustive or to limit the invention to the precise forms disclosed. Obviously many other modifications and variations are possible. In particular, the specific type and quantity of components that make up the drilling assembly 100 could be varied. Further, the quantity of cutting structures 330, 340 provided on the cutting devices 300, 400 could be varied, as well as the specific means by which such cutting structures 330, 340 are presented. For example, instead of retracting the piston 370, in other embodiments, the piston 370 may be advanced to actuate the cutting devices 300, 400. In other embodiments, the piston 370 may be retracted and extended multiple times. In addition, the materials comprising the cutting structures 330, 340 could be varied as required for the milling or drilling operation. Further, the tracks 322, 422 may have any angle, including a reverse angle, such that the moveable cutter blocks 340 are moved radially inwardly when the piston 370 retracts. In addition, the expandable cutting device 300 may be expanded at different times in the method, such as during milling of the casing window 35, for example.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What we claim as our invention is:

1. A method of milling a window through a casing in a primary well bore and drilling a sidetracked well bore into a formation comprising:

running a drilling assembly including a body having an axis defined therethrough and a track formed thereon, a piston that is movable within a cavity formed in the body, a stationary cutting structure coupled to the body, and a movable cutting structure coupled to the body, wherein the movable cutting structure is coupled to the piston via a link and is slidingly engaged with the track formed on the body and is movable along the track between a collapsed position and an expanded position;

milling a window through the casing in a first trip into the primary well bore;

drilling the sidetracked well bore in the first trip into the primary well bore;

applying a differential pressure across a lower end of the piston;

retracting the movable piston disposed in the cavity formed in the body of the drilling assembly from a downstream position to an upstream position; and moving the movable cutting structure along the track from the collapsed position to the expanded position via the link during the retracting of the movable piston.

2. The method of claim 1, wherein the applying the differential pressure across the piston displaces the piston from the downstream position to the upstream position.

3. The method of claim 2, further comprising shearing a shear screw when the piston is displaced from the downstream position to the upstream position.

4. The method of claim 1, wherein moving the movable cutting structure from the collapsed position to the expanded position includes radially expanding the movable cutting structure.

5. The method of claim 1, wherein an initial gauge of the stationary cutting structure is greater than an effective gauge of the movable cutting structure in the collapsed position.

6. The method of claim 1, wherein an effective gauge of the movable cutting structure in the expanded position is substantially equal to an initial gauge of the stationary cutting structure.

7. The method of claim 1, wherein applying a pressure differential across the piston includes creating a pressure differential between an internal chamber formed in the body and the primary wellbore to move the piston from the collapsed position to the expanded position.

8. The method of claim 7, wherein an upper end of the piston is in fluid communication with the primary wellbore and a lower end of the piston is in fluid communication with the internal chamber of the body.

9. The method of claim 1, wherein an angle is formed between a direction in which the track formed on the body extends and the axis defined through the body.

10. The method of claim 1, further comprising moving the movable cutting structure to the expanded position when at least one of a formation type or a formation integrity changes.

11. A drilling assembly comprising:

a body having a track formed thereon, a cavity formed therein, and an axis defined therethrough, a piston disposed within the cavity of the body, the piston configured to be retracted and extended multiple times within the cavity along the axis of the body;

a stationary cutting structure coupled to the body; and a movable cutting structure coupled to the piston via a link and slidingly engaged with the track, the movable cutting structure movable between a collapsed position and an expanded position, wherein, in the collapsed position, the piston is positioned in a downstream position and, in the expanded position, the piston is positioned in an upstream position.

12. The assembly of claim 11, wherein, in the collapsed position, a leading end of the movable cutting structure is positioned downstream of a leading end of the stationary cutting structure.

13. The assembly of claim 11, wherein, in the expanded position, a leading end of the movable cutting structure is positioned upstream of a leading end of the stationary cutting structure.

14. The assembly of claim 11, wherein the track formed on the body extends in a direction that is substantially parallel to the axis defined through the body.

15. The assembly of claim 11, wherein an angle is formed between the direction in which the track formed on the body extends and the axis defined through the body.

16. The assembly of claim 11, wherein an effective gauge of the movable cutting structure in the expanded position is substantially equal to an initial gauge of the stationary cutting structure.

17. The assembly of claim 11, wherein an upper end of the piston is in fluid communication with a primary wellbore and a lower end of the piston is in fluid communication with an internal chamber formed in the body.

* * * * *